US006247901B1

(12) United States Patent
Unger

(10) Patent No.: US 6,247,901 B1
(45) **Date of Patent: *Jun. 19, 2001**

(54) COMPRESSOR FOR GENERATING COMPRESSED AIR IN MOTOR VEHICLES

(76) Inventor: Hans Unger, St. Benedikstr. 5, D-85716 Unterschleissheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/024,405

(22) Filed: Feb. 17, 1998

(30) Foreign Application Priority Data

Feb. 17, 1997 (DE) ..... 197 06 066

(51) Int. Cl.[7] ..... F04B 49/00; F04B 1/12
(52) U.S. Cl. ..... 417/223; 417/269
(58) Field of Search ..... 417/223, 319, 417/553, 269; 92/71, 12.2; 184/6.16

(56) References Cited

U.S. PATENT DOCUMENTS

| | | | | |
|---|---|---|---|---|
| 3,577,891 | * | 5/1971 | Nemoto et al. | 417/312 |
| 3,817,660 | * | 6/1974 | Knowles et al. | 417/269 |
| 3,945,765 | * | 3/1976 | Toyoda et al. | 417/269 |
| 3,961,868 | * | 6/1976 | Droege, Sr. et al. | 417/550 |
| 3,999,894 | * | 12/1976 | Nakayama et al. | 417/269 |
| 4,090,430 | | 5/1978 | Matsumoto et al. . | |
| 4,415,315 | * | 11/1983 | Shibuya | 417/269 |
| 4,495,855 | | 1/1985 | Murakami et al. . | |
| 5,492,459 | | 2/1996 | Burkett et al. . | |
| 5,517,953 | * | 5/1996 | Wiesen | 123/51 R |
| 5,540,560 | * | 7/1996 | Kimura et al. | 417/223 |

FOREIGN PATENT DOCUMENTS

| | | |
|---|---|---|
| 661 954 | 6/1938 | (DE) . |
| 1 083 480 | 7/1965 | (DE) . |
| 1955447 | 5/1971 | (DE) . |
| 2436407A1 | 2/1976 | (DE) . |
| 35 45 581 C2 | 7/1986 | (DE) . |
| 19501220A1 | 7/1996 | (DE) . |
| 1 571 234 | 6/1969 | (FR) . |
| 2 175 653 | 12/1986 | (GB) . |

* cited by examiner

*Primary Examiner*—Henry C. Yuen
*Assistant Examiner*—Mahmoud M Gimie
(74) *Attorney, Agent, or Firm*—Crowell & Moring, L.L.P.

(57) ABSTRACT

In an axial piston compressor, especially a swash plate compressor for generating compressed air in motor vehicles, an oil-lubricated drive and an air compressor part that operates without oil are provided. The pistons that travel in cylinder bores under the guidance of a swash plate each have at their backs the intake chamber formed by chambers and a pressure chamber on the front. Intake valves are mounted on the pistons, while pressure valves are provided in cylinder head, cooled by cooling oil or water. The seal between oil-lubricated drive and the compressor part that operates without oil is provided by sealing elements that act on the outer circumference of the piston rods of the pistons. When cooling oil is used to cool the cylinder head, this oil simultaneously serves as the lubricating oil for drive

20 Claims, 1 Drawing Sheet

COMPRESSOR FOR GENERATING COMPRESSED AIR IN MOTOR VEHICLES

BACKGROUND AND SUMMARY OF THE INVENTION

This application claims the priority of German application 197 06 066.8 filed in Germany on Feb. 17, 1997, the disclosure of which is expressly incorporated by reference herein.

The invention relates to a compressor for generating compressed air in motor vehicles, with a drive driven by a drive shaft, provided with a swash plate and lubricated by oil, said drive being connected by piston rods with pistons traveling in cylinder bores.

One-cylinder or two-cylinder compressors are used everywhere today for generating compressed air in motor vehicles. The compressors are mounted on the engines of the vehicles and are driven directly off the engine through gears, and in some cases by V-belts as well. The compressors are lubricated by the oil circuits of the engines. As a result, oil also necessarily enters the compressed air through the compressor pistons. Depending on the condition of the compressors, these quantities of oil can be considerable and for the most part they enter the environment at the ventilation openings of the compressed air systems, usually onto the road, and hence can be viewed as an environmental hazard. With the high operating pressures conventionally used today and the high thermal stress associated therewith, a portion of this oil is also coked in the compressor; the oil coke settles out in the cylinder head of the compressor and in the devices connected downstream, where it has a highly deleterious effect on service life.

These compressors are regulated by pressure regulator valves (governors). The air stream delivered by the constantly driven compressor is throttled by a device on the compressor during the idle phase or vented into the atmosphere by vent devices on the pressure-regulating valves. The energy consumed by the compressor during this idle phase amounts to pure lost energy. The share of this lost energy within the total energy consumption of the compressor is not insignificant because the effective ON time ED, in other words the time during which the compressor is delivering compressed air to the system, rarely comprises more than 30% of the entire operating time of a vehicle. The compressor is not shut down by means of a shutoff clutch for example because the torque curve, especially the torque peaks, makes very large and expensive clutches necessary.

Another disadvantage consists of the negative torque components after the top dead center (TDC) point of the piston in the compressor. These components in a gear drive result in flank alternation in the gears and hence to a considerable noise impact. In vehicles in which this is not desirable, expensive measures applied to the gears (minimization of flank play, gears pretensioned tangentially) are employed to solve this problem more or less satisfactorily.

Hence, a goal of the invention is to design a compressor that is used especially for generating compressed air in motor vehicles, said compressor not suffering from the above disadvantages and problems and, with its compact design, nevertheless being possible to manufacture economically by comparison with compressors of current design.

This goal is achieved according to preferred embodiments of the invention by providing a compressor for generating compressed air in motor vehicles, with a drive driven by a drive shaft, provided with a swash plate and lubricated by oil, said drive being connected by piston rods with pistons traveling in cylinder bores, wherein the oil-lubricated drive of the compressor is sealed off from oil-free chambers located on backs of respective ones of the pistons by sealing elements acting relative to each of the piston rods, wherein the oil free chambers are connected with one another by an annular chamber and are linked to a common intake connection, and wherein each piston has an intake valve such that pressure chambers of the compressor are formed between the front of the respective piston and the cylinder head.

The compressors according to the invention are characterized by largely oil-free operation since the wiping and sealing elements acting on the piston rods create a very effective seal between the drive and compressor parts, in other words, with respect to the intake chamber located on the back of the piston.

In this way, it is possible to mount the intake valves on the piston, in other words the compressor draws in air through the pistons. This also has the advantage that more room is available for cooling in the cylinder head, so that in many cases it is possible to cool the compressor with cooling oil from the lubricant circuit of the vehicle. However, this does not rule out the use of water cooling for the compressor under higher thermal stress.

Other objects, advantages and novel features of the present invention will become apparent from the following detailed description of the invention when considered in conjunction with the accompanying drawings.

DETAILED DESCRIPTION OF THE DRAWINGS

Figure 2:
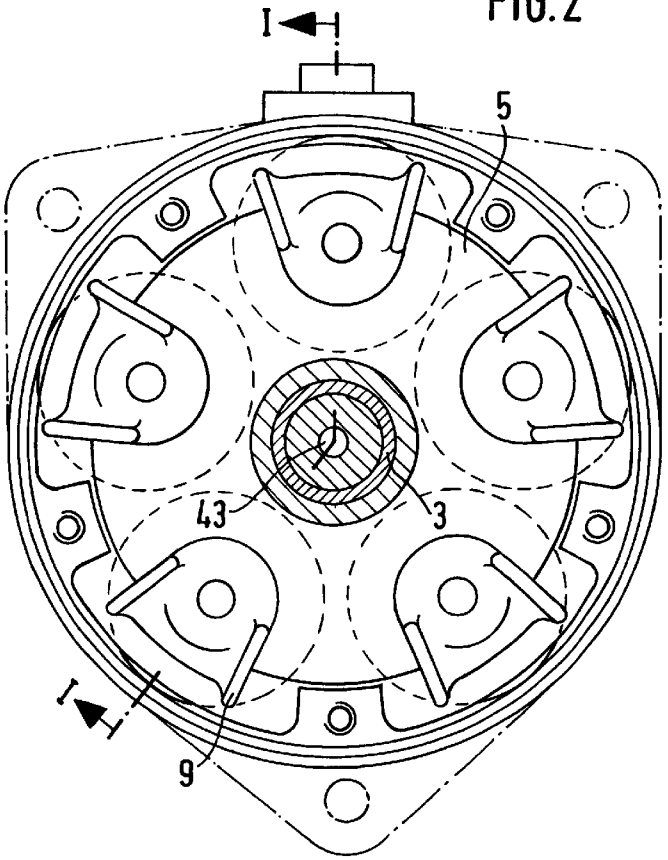
FIG. 2 is a part sectional plan view taken along line II—II in FIG. 1.
Figure 1:
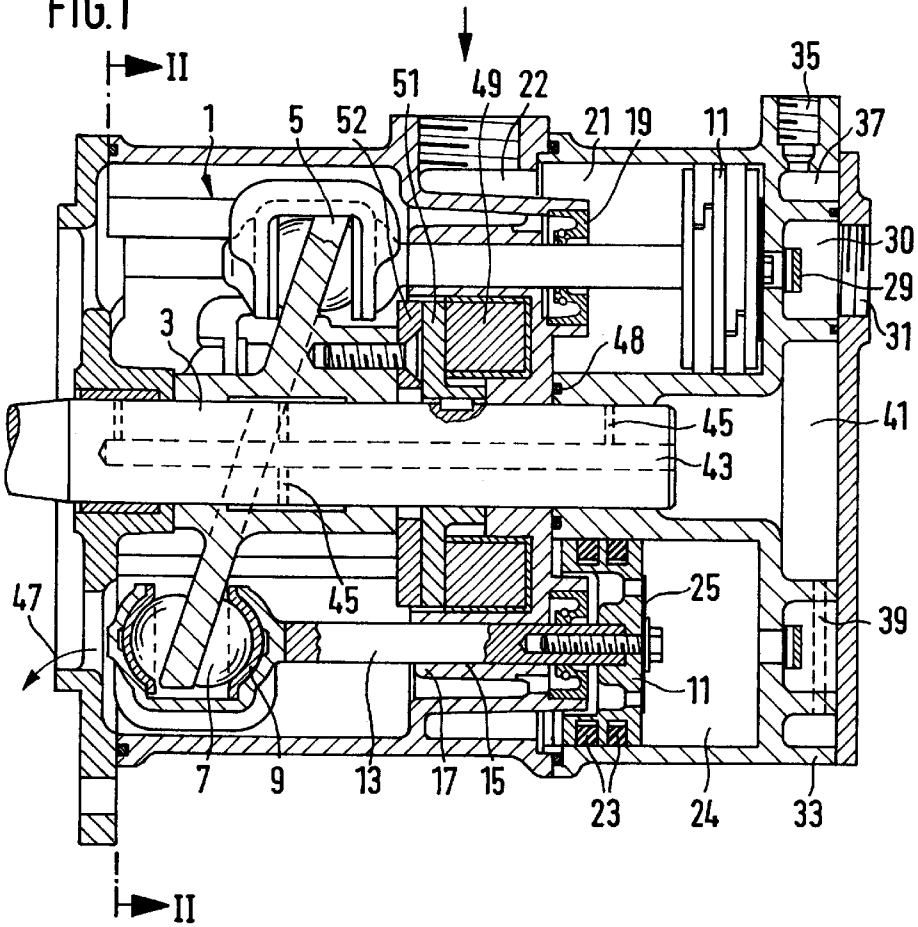
FIG. 1 is a lengthwise sectional view through a compressor constructed according to the invention, with one of the pistons being shown in an offset operating position via the sectional view being taken along line I—I in FIG. 2.

The axial piston compressor shown in FIGS. 1 and 2, in the form of a swash plate compressor, has an oil-lubricated drive 1, consisting essentially of a swash plate 5 mounted on a drive shaft 3 and hemispheres 7 in step bearings 9. Drive 1 with a known type of operation is used in order to produce straight-line movements of piston rods 13 supporting pistons 11 as drive shaft 3 turns. Piston rods 13 are mounted in bearing bores 15 on the oil-lubricated drive side. Bearing bores 15 extend along an arc of a circle at intervals with respect to one another, parallel to the lengthwise axis of the compressor that extends through a central housing section 17, at which oil-wiping sealing elements 19 are provided, facing the pistons. The chambers 21 located at the backs of the pistons are connected by an annular chamber 22 (FIG. 1) to form a common intake chamber, in which an intake connection terminates.

Pistons 11 are equipped with piston rings 23 suitable for oil-free dry running and preferably move without contact in the cylinder bores.

Each of the chambers 21 located on the backs of the pistons, acting as intake chambers, is separated in the manner described above in each case by a piston 11 from the pressure chamber 24 of the compressor, with each of pistons 11 having an intake valve 25. This intake valve 25, during the intake stroke of the piston, forms the connection between the intake chamber and the pressure chamber 24, with the valve opening during the movement of the individual piston to the left as shown in FIG. 1, in such fashion that air enters pressure chamber 24 through the intake connection and chambers 21 connected therewith and is expelled during the subsequent movement to the right as shown in FIG. 1, with intake valve 25 closing, through pressure valve 29 shown in the sectional view and through annular pressure chamber 30 into pressure connection 31.

By dividing the working volume into two parts as described above, namely the intake chamber and the pressure chamber, it is possible to cool cylinder head 33 of the compressor that carries pressure valves 29 in an optimum fashion, since more cooling area is available. In the embodiment shown in FIGS. 1 and 2, the cooling oil and lubricating oil circuits are identical, with the oil being supplied under pressure to the compressor through inlet 35 from the lubricant circuit of the vehicle engine. The oil initially flows through the cylinder head into central oil chamber 41 for cooling via annular chamber 37 and connection 39; the oil chamber is delimited by the end of drive shaft 3 of the compressor. An oil bore 43 extends centrally through the drive shaft, with branch bores 45 branching off from the oil bore at various positions. With the aid of the first branch bore relative to oil chamber 41, the right-hand end of drive shaft 3 is lubricated as shown. Oil is supplied through other branch bores into the interior of the drive. Inside the drive, the oil serves to lubricate all of the parts subject to friction and leaves the compressor through an outlet 47 that communicates with the interior of the drive. In the area of lubrication of the right-hand end of drive shaft 3, a seal 48 is provided that prevents penetration of oil into the intake chambers. The oil returns through outlet 47 to the lubricant circuit of the vehicle engine.

The transport of the cooling oil is not limited to the connection of oil bore 43 and branch bores 45, in other words in another version cooling oil 41 is conducted along the outer circumference of the housing or through channels located in the housing wall into drive 1. In this case, oil chamber 41 is sealed off from the facing end of drive shaft 3.

When water from the cooling circuit of the vehicle engine is used to cool the compressor, the above lubricant and coolant circuits are separated and the connection 39 shown in FIG. 1 is eliminated. Cooling water is introduced through inlet 35. In the embodiment shown in FIGS. 1 and 2, the cooling water outlet and the lubricant inlet located on the other side of the compressor are not shown.

The highly favorable torque curve of the compressor described above makes it possible to use a compact, economical shutoff clutch. It is possible to accommodate the shutoff clutch, shown here as an electromagnetic clutch 49, compactly in the interior of the compressor. Swash plate 5 in this case is mounted rotatably on drive shaft 3 and is driven by a magnetic disk 51 nonrotatably mounted on drive shaft 3 when the magnet is energized. Magnetic disk 51 drives follower disk 52, connected with swash plate 5 by screws for example, through friction. When the magnet is de-energized, the engagement between the follower disk and the magnetic disk is broken so that drive shaft 3 turns at idle and the compressor piston is disconnected.

In a similar design according to another contemplated embodiment of the invention, regulation using a pneumatically switched clutch is possible.

With the type of shutoff regulation explained above, it is possible to drive other devices, a power steering pump for example, with the compressor running, even if the compressor is disconnected. The possibility of regulating the compressor by using a shutoff clutch, in addition to creating optimum energy savings, has the advantage of increasing the service life of piston rings 23 which run oil-free, as well as the service life of sealing elements 19 on piston rods 13 to the point where, in view of the maximum ON time ED of 30% mentioned at the outset, a generally satisfactory service life is achieved with these components.

Because the drive shaft and swash plate are separate in the compressor according to the invention, the swash plate can be made of a material such as cast aluminum that can be manufactured economically and has good sliding ability.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Compressor for generating compressed air in motor vehicles, comprising an oil lubricated drive having a drive shaft and a swash plate mounted on the drive shaft and lubricated by oil, said drive being connected by piston rods with pistons traveling in cylinder bores, said pistons having respective fronts facing a cylinder head and respective backs facing oppositely of the fronts, wherein the oil-lubricated drive of the compressor is sealed off from oil-free chambers located on the backs of respective ones of the pistons by sealing elements acting relative to each of the piston rods, wherein the oil free chambers are connected with one another by an annular chamber and are linked to a common intake connection, and wherein each piston has an intake valve such that pressure chambers of the compressor are formed between the front of the respective piston and the cylinder head.

2. Compressor according to claim 1, wherein the cylinder head carries pressure valves of the compressor, and wherein the cylinder head has at least one coolant chamber for cooling the pressure side of the compressor using cooling oil or water.

3. Compressor according to claim 1, wherein the drive of the compressor is lubricated by the cooling oil of cylinder head when cooling oil is used.

4. Compressor according to claim 2, wherein the drive of the compressor is lubricated by the cooling oil of the cylinder head when cooling oil is used.

5. Compressor according to claim 3, wherein the at least one coolant chamber includes an annular chamber inside the cylinder head communicating with an inlet for the cooling and lubricating oil;

wherein the cylinder head, inside the compressor, delimits an oil chamber that extends centrally toward the drive and is linked through a connection with the annular chamber, and wherein the oil chamber is delimited on the drive side by the drive shaft and is connected by bores that extend in the drive shaft and lead to the drive.

6. Compressor according to claim 4, wherein the at least one coolant chamber includes an annular chamber inside the cylinder head communicating with an inlet for the cooling and lubricating oil;

wherein the cylinder head, inside the compressor, delimits an oil chamber that extends centrally toward the drive and is linked through a connection with the annular chamber, and wherein the oil chamber is delimited on the drive side by the drive shaft and is connected by bores that extend in the drive shaft and lead to the drive.

7. Compressor according to claim 1, comprising a clutch that surrounds the drive shaft inside the compressor, said clutch being actuable electromagnetically or pneumatically, for coupling the drive shaft to the swash plate.

8. Compressor according to claim 2, comprising a clutch that surrounds the drive shaft inside the compressor, said clutch being actuable electromagnetically or pneumatically, for coupling the drive shaft to the swash plate.

9. Compressor according to claim 3, comprising a clutch that surrounds the drive shaft inside the compressor, said clutch being actuable electromagnetically or pneumatically, for coupling the drive shaft to the swash plate.

10. Compressor according to claim 4, comprising a clutch that surrounds the drive shaft inside the compressor, said clutch being actuable electromagnetically or pneumatically, for coupling the drive shaft to the swash plate.

11. Compressor according to claim 5, comprising a clutch that surrounds the drive shaft inside the compressor, said clutch being actuable electromagnetically or pneumatically, for coupling the drive shaft to the swash plate.

12. Compressor according to claim 6, comprising a clutch that surrounds the drive shaft inside the compressor, said clutch being actuable electromagnetically or pneumatically, for coupling the drive shaft to the swash plate.

13. Compressor according to claim 7, wherein the swash plate is mounted rotatably on the drive shaft, and is selectively coupled nonrotatably by means of the clutch with the drive shaft so that the swash plate and the drive shaft can be made of different materials.

14. Compressor according to claim 13, wherein the drive shaft is made of steel, and wherein the swash plate is made of a material that can be manufactured economically and has good sliding properties.

15. Compressor according to claim 14, wherein the swash plate is made of cast aluminum.

16. Compressor according to claim 8, wherein the swash plate is mounted rotatably on the drive shaft, and is selectively coupled nonrotatably by means of the clutch with the drive shaft so that the swash plate and the drive shaft can be made of different materials.

17. Compressor according to claim 16, wherein the drive shaft is made of steel, and wherein the swash plate is made of a material that can be manufactured economically and has good sliding properties.

18. Compressor according to claim 2, wherein the swash plate is mounted rotatably on the drive shaft, and is selectively coupled nonrotatably by means of the clutch with the drive shaft so that the swash plate and the drive shaft can be made of different materials.

19. Compressor according to claim 18, wherein the drive shaft is made of steel, and wherein the swash plate is made of a material that can be manufactured economically and has good sliding properties.

20. Compressor for generating compressed air in motor vehicles, comprising an oil lubricated drive and a swash plate mounted on the drive shaft and lubricated by oil, said drive being connected by piston rods with pistons traveling in cylinder bores, said pistons having respective fronts facing a cylinder head and respective backs facing oppositely of the fronts, wherein the oil-lubricated drive of the compressor is sealed off from oil-free chambers located on the backs of respective ones of the pistons by sealing elements acting relative to each of the piston rods, and wherein pressure chambers are formed between the front of the respective piston and the cylinder head to which air enters through intake valves, the improvement consisting in that the oil free chambers are connected with one another by an annular chamber and are linked to a common intake connection and each piston is equipped with an intake valve.

* * * * *